US007754402B2

(12) United States Patent
Hamasaki et al.

(10) Patent No.: US 7,754,402 B2
(45) Date of Patent: Jul. 13, 2010

(54) ELECTROPHOTOGRAPHIC PHOTOCONDUCTIVE MEMBER AND IMAGE FORMING APPARATUS

(75) Inventors: Kazunari Hamasaki, Osaka (JP); Shiho Kuboshima, Osaka (JP); Daisuke Kuboshima, Osaka (JP); Yuko Iwashita, Osaka (JP)

(73) Assignee: Kyocera Mita Corporation (JP)

( * ) Notice: Subject to any disclaimer, the term of this patent is extended or adjusted under 35 U.S.C. 154(b) by 424 days.

(21) Appl. No.: 12/002,938

(22) Filed: Dec. 19, 2007

(65) Prior Publication Data

US 2008/0153020 A1 Jun. 26, 2008

(30) Foreign Application Priority Data

Dec. 20, 2006 (JP) ..... 2006-342692

(51) Int. Cl.
*G03G 5/06* (2006.01)

(52) U.S. Cl. ..... 430/58.65; 430/96; 399/176

(58) Field of Classification Search ..... 430/58.65, 430/96; 399/176
See application file for complete search history.

(56) References Cited

U.S. PATENT DOCUMENTS 7,416,825 B2 * 8/2008 Kuboshima et al. ..... 430/96

FOREIGN PATENT DOCUMENTS

JP 2005-289877 10/2005

* cited by examiner

*Primary Examiner*—John L Goodrow
(74) *Attorney, Agent, or Firm*—Gerald E. Hespos; Michael J. Porco

(57) ABSTRACT

The present invention provides an electrophotographic photoconductive member comprising a substrate, and a photoconductive layer containing a hole transferring material, a charge generating material and a binder resin, wherein a value (IV/OV value) in which the inorganic value is divided by the organic value of the binder resin is 0.36 or more and the hole transferring material contains an amine compound represented by the following general formula (1):

(1)

10 Claims, 4 Drawing Sheets

ELECTROPHOTOGRAPHIC PHOTOCONDUCTIVE MEMBER AND IMAGE FORMING APPARATUS

BACKGROUND OF THE INVENTION

1. Field of the Invention

The present invention relates to an electrophotographic photoconductive member and an image forming apparatus. More particularly, the present invention relates to an electrophotographic photoconductive member which is excellent in electrical characteristics and also can suppress generation of cracks in a photoconductive layer and black spots arising from the cracks in the formed image, and an image forming apparatus equipped with the electrophotographic photoconductive member.

2. Description of the Related Art

As an electrophotographic photoconductive member, which has hitherto been used in an image forming apparatus, a photoconductive member having an organic photoconductive (OPC) layer containing a charge generating material, a charge transferring material (a hole transferring material or an electron transferring material) and a binder resin is used. Such a photoconductive member having the OPC layer has an advantage that it is easily produced as compared with a conventional electrophotographic photoconductive member having an inorganic photoconductive layer and also has a high degree of freedom of design because of a wide selection range of photoconductive materials.

It is required for the charge transferring material to have a high charge transfer rate so as to impart high electrical characteristics to the electrophotographic photoconductive member.

Japanese Unexamined Patent Publication (Kokai) No. 2005-289877(Patent Document 1) discloses, as a hole transferring material having a high charge transfer rate, an amine compound represented by the following general formula (33):

(33)

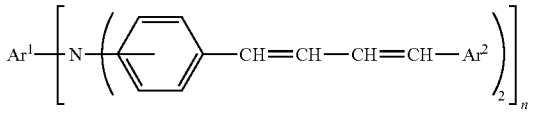

wherein, in the general formula (33), $Ar^1$ represents a benzene ring having one or more substituents, a condensed aromatic ring which may have a substituent, a heterocycle which may have a substituent, or a condensed heterocycle which may have a substituent; $Ar^2$ represents a benzene ring which may have a substituent, a condensed aromatic ring which may have a substituent, a heterocycle which may have a substituent, or a condensed heterocycle which may have a substituent; and n represents an integer of 1 to 3.

The amine compound represented by the general formula (33) has a high charge transfer rate. However, a photoconductive layer containing such an amine compound has a problem that it easily separates from a substrate and cracks are easily generated. There is a problem that, when an oil component such as sebum of a human hand or grease of a driving roller adheres onto the surface of an electrophotographic photoconductive member, cracks are easily generated around the point on which the oil component is adhered in the photoconductive layer. Also there is a problem that such cracks cause generation of black spots in the formed image.

SUMMARY OF THE INVENTION

An object of the present invention provides an electrophotographic photoconductive member which can suppress generation of cracks in a photoconductive layer and black spots arising from the cracks in the formed image while maintaining high electrical characteristics, and an image forming apparatus equipped with the electrophotographic photoconductive member.

One aspect of the present invention pertains to an electrophotographic photoconductive member comprising a substrate, and a photoconductive layer containing a hole transferring material, a charge generating material and a binder resin, wherein the binder resin has a IV/OV value in which an inorganic value (IV) is divided by an organic value (OV) of 0.36 or more and also, the hole transferring material contains an amine compound represented by the following general formula (1)

(1)

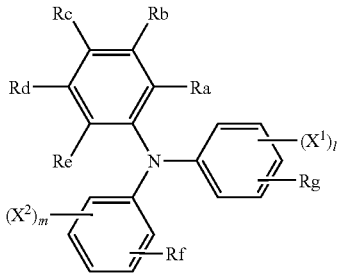

wherein, in the general formula (1), Ra to Rg each independently represents a hydrogen atom, a halogen atom, an alkyl group having 1 to 20 carbon atoms, an alkoxy group having 1 to 20 carbon atoms, or a substituted or unsubstituted aryl group having 6 to 30 carbon atoms, or a hydrocarbon ring structure formed from two adjacent substituents among Ra to Re; $X^1$ and $X^2$ each independently represents a substituent represented by the following general formula (2), and each may be the same or different when a plurality of either or both of $X^1$ and/or $X^2$ exist; and the number of substituents l and m represent an integer of 0 or a positive integer, which satisfy the following relation: ($l+m \geqq 2$);

(2)

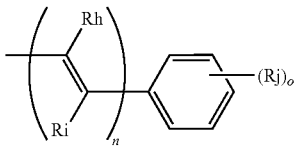

wherein, in the general formula (2), Rh and Ri each represents a hydrogen atom, an alkyl group having 1 to 20 carbon atoms, or a substituted or unsubstituted aryl group having 6 to 30 carbon atoms; a repeating number n represents an integer of 1 or 2; Rj represents a halogen atom, an alkyl group having 1 to 20 carbon atoms, an alkoxy group having 1 to 20 carbon atoms, or a substituted or unsubstituted aryl group having 6 to 30 carbon atoms, and may be the same or different when a plurality of Rj exist; and the number of a substituent o represents an integer of 0 to 5.

Objects, features, aspects and advantages of the present invention become more apparent from the following detailed description and accompanying drawings.

DETAILED DESCRIPTION OF THE PREFERRED EMBODIMENTS

First Embodiment

Single-Layered Electrophotographic Photoconductive Member

Hereinafter, a single-layered electrophotographic photoconductive member (hereinafter, simply called as "photoconductive member") according to a first embodiment of the present invention will be described.

First, the basic constitution of a single-layered photoconductive member according to the first embodiment will be described with reference to FIG. 1A and FIG. 1B.

Figure 1A:
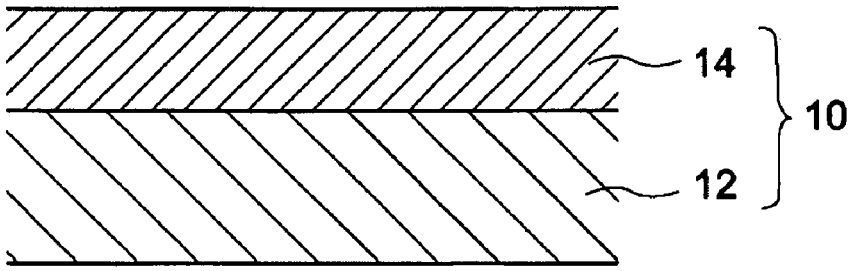
FIG. 1A is a schematic cross-sectional view showing a layered structure of a single-layered electrophotographic photoconductive member according to a first embodiment.

FIG. 1A is a schematic sectional view showing a single-layered photoconductive member 10 including a substrate 12, and a single photoconductive layer 14 formed on the surface of the substrate 12.

The substrate may be used without any limitation as long as the entire substrate has conductivity or the surface portion of the substrate has conductivity. Specific examples thereof include metals such as iron, aluminum, copper, tin, platinum, silver, vanadium, molybdenum, chromium, cadmium, titanium, nickel, palladium, indium, stainless steel, and brass; plastic materials on which each metal described above is vapor deposited or laminated; plastic materials in which conductive fine particles such as carbon black are dispersed; and glass coated with aluminum iodide, tin oxide, or indium oxide.

As the shape of the substrate, for example, a sheet or a drum is selected according to the structure of the image forming apparatus to be installed.

The photoconductive layer contains a binder resin having an IV/OV value of 0.36 or more, a hole transferring material composed of an amine compound represented by the general formula (1) and a charge generating material, which will be described in detail hereinafter, and also optionally contains additives such as an electron transferring material, a leveling agent, and a silyl group-containing compound. When the photoconductive layer contains the electron transferring material, charge transfer efficiency between the charge generating material and the hole transferring material is further improved.

Figure 1B:
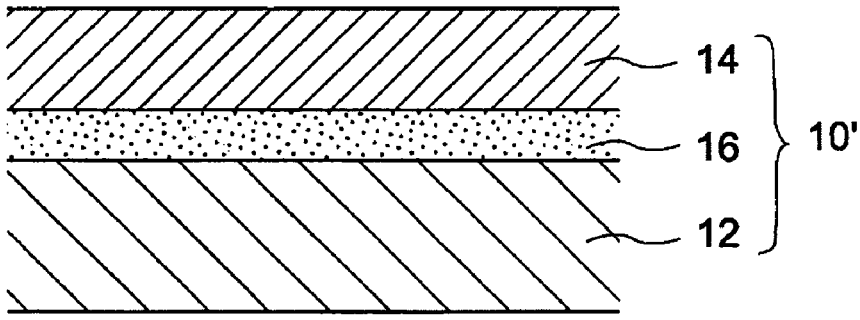
FIG. 1B is a schematic cross-sectional view showing a layered structure of another single-layered electrophotographic photoconductive member according to the first embodiment.

FIG. 1B is a schematic sectional view showing a single-layered photoconductive member 10' including a substrate 12, an intermediate layer (a barrier layer) 16 formed on the surface of the substrate 12, and a photoconductive layer 14 formed on the surface of the intermediate layer 16. In the single-layered photoconductive member 10' shown in FIG. 1B, the intermediate layer 16 is formed for the purpose of preventing generation of interference fringe through formation of light scattering. As the intermediate layer, a layer formed by dispersing organic fine powders or inorganic fine powders in a binder resin is preferably used.

The hole transferring material used in the photoconductive member according to the present embodiment will now be described.

The hole transferring material used in the present embodiment contains the amine compound represented by the following general formula (1):

(1)

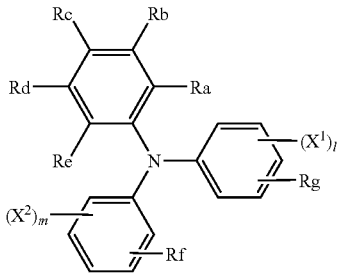

wherein, in the general formula (1), Ra to Rg each independently represents a hydrogen atom, a halogen atom, an alkyl group having 1 to 20 carbon atoms, an alkoxy group having 1 to 20 carbon atoms, or a substituted or unsubstituted aryl group having 6 to 30 carbon atoms, or a hydrocarbon ring structure formed from two adjacent substituents among Ra to Re; $X^1$ and $X^2$ each independently represents a substituent represented by the following general formula (2), and each may be the same or different when a plurality of either or both of $X^1$ and/or $X^2$ exist; and the number of substituents l and m represent an integer of 0 or a positive integer, which satisfy the following relation: ($l+m \geqq 2$);

(2)

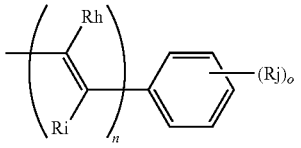

wherein, in the general formula (2), Rh and Ri each represents a hydrogen atom, an alkyl group having 1 to 20 carbon atoms, or a substituted or unsubstituted aryl group having 6 to 30 carbon atoms; a repeating number n represents an integer of 1 or 2; Rj represents a halogen atom, an alkyl group having 1 to 20 carbon atoms, an alkoxy group having 1 to 20 carbon atoms, or a substituted or unsubstituted aryl group having 6 to 30 carbon atoms, and may be the same or different when a plurality of Rj exist; and the number of a substituent o represents an integer of 0 to 5.

The amine compound is excellent in an ability of receiving electric charges generated from a charge generating material, an ability of quickly transferring received electric charges, and an ability of sufficiently transferring electric charges even in a low electric field and suppressing generation of the residual electric charges in a photoconductive layer. Therefore, the hole transferring material exhibits a high hole transfer rate and thus a photoconductive member having high electrical characteristics is obtained.

There was a problem that, when an oil component adheres onto the surface of the photoconductive layer containing the amine compound, cracks are easily generated in the vicinity of the point on which the oil component adheres. A cause of the problem is considered as follows.

Since the amine compound has high crystallinity, dispersibility of the amine compound is low in the photoconductive layer. When the oil component partially adheres onto the surface of the photoconductive layer, the amine compound having low dispersibility in the photoconductive layer easily elutes in the partially adhered oil component. Also, voids are formed at the portion where the amine compound in the photoconductive layer is eluted. In the vicinity of the voids, cracks are easily generated because local stress is produced.

Namely, it is considered that generation of cracks in the photoconductive layer is cause by a local stress-producing phenomenon arising from an elution phenomenon of the amine compound in the vicinity of the voids. As a result of the study, it is considered that generation of cracks is reduced by suppressing at least one phenomenon of the elution phenomenon of the amine compound and the stress-producing phenomenon in the vicinity of the voids.

In the present embodiment, as described hereinafter, by using a binder resin having an IV/OV value of 0.36 or more, stability of the binder resin to the oil component is improved and the elution phenomenon of the amine compound is suppressed, and thus generation of cracks is reduced. Furthermore, by using the binder resin, since the amine compound is excellent in compatibility with the binder resin, it becomes difficult for the amine compound to be crystallized, and high dispersibility of the amine compound is obtained in the photoconductive layer.

As the amine compound represented by the general formula (1), amine compounds represented by the following general formulas (3) to (5) are preferably used in view of low crystallinity:

(3)

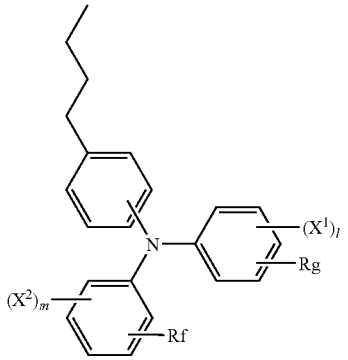

wherein, in the general formula (3), Rg, Rf, $X^1$, $X^2$ and the number of substituents l and m are as defined in the general formula (1);

(4)

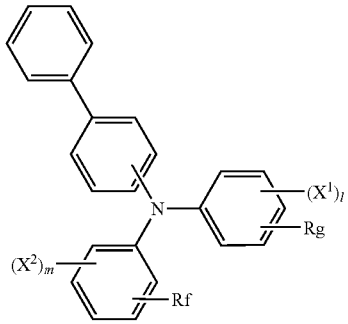

wherein, in the general formula (4), Rg, Rf, $X^1$, $X^2$ and the number of substituents l and m are as defined in the general formula (1); and (5)

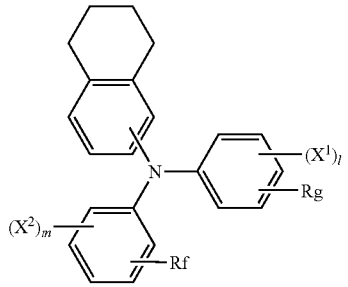

wherein, in the general formula (5), Rg, Rf, $X^1$, $X^2$ and the number of substituents l and m are as defined in the general formula (1).

The amine compounds represented by the general formulas (3) to (5) are those in which flatness and symmetry of the molecule are controlled by selecting a n-butyl group, a phenyl group or a cyclohexyl group, as a substituent of the aryl group having substituents $R_a$ to $R_e$ among three aryl groups bonded to nitrogen atoms in the general formula (1). Since these amine compounds represented by the general formulas (3) to (5) have low crystallinity, an electrophotographic photoconductive member having high electrical characteristics can be easily obtained and also generation of cracks and black spots arising from the cracks in the formed image can be effectively suppressed.

Specific examples of the amine compound represented by the general formula (1) include compounds represented by the following formulas (11) to (20) (HTM-1 to HTM-10).

Amine compounds (HTM-1 and HTM-7) represented by the general formulas (11) and (17) are included in the amine compound represented by the general formula (3), amine compounds (HTM-2 and HTM-8) represented by the general formulas (12) and (18) is included in an amine compound represented by the general formula (4), and amine compounds (HTM-3 and HTM-9) represented by the general formulas (13) and (19) are included in the amine compound represented by the general formula (5).

(11)
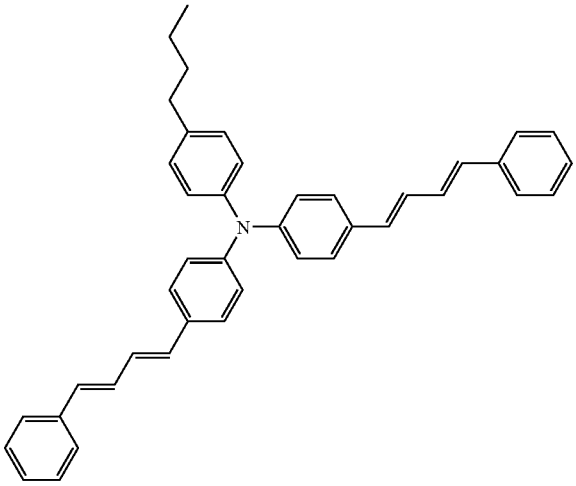
(HTM-1)
(12)
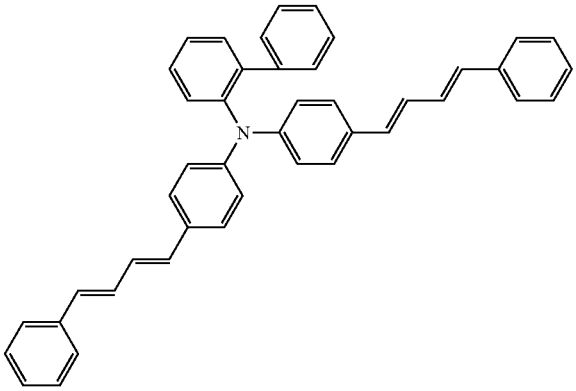
(HTM-2)
(13)
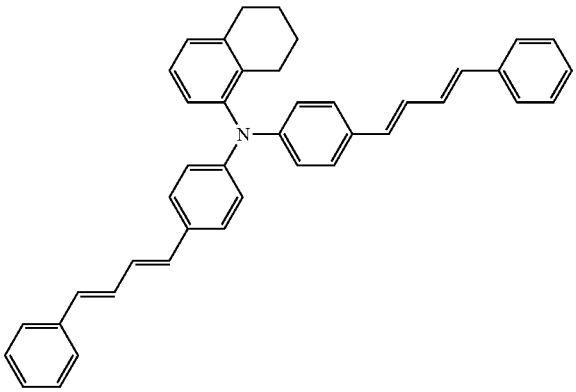
(HTM-3)
-continued
(14)
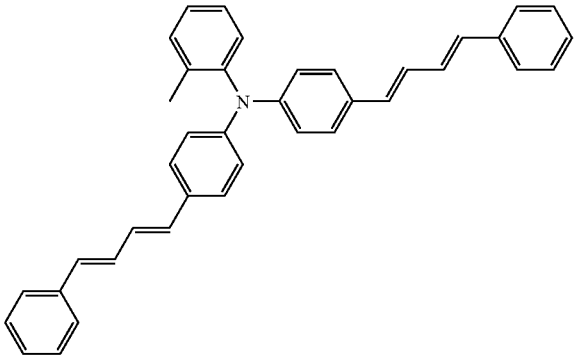
(HTM-4)
(15)
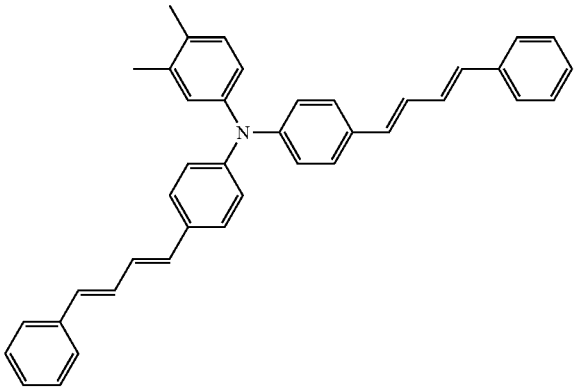
(HTM-5)
(16)
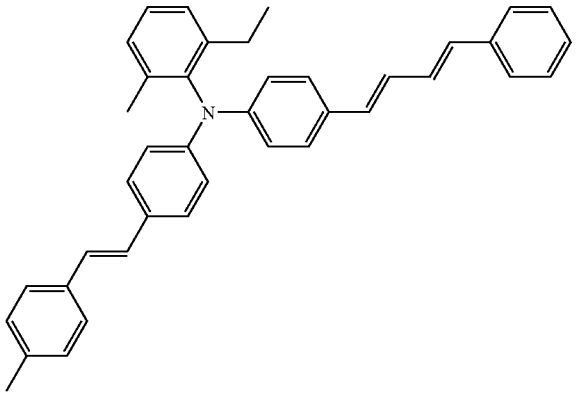
(HTM-6)

-continued (17)

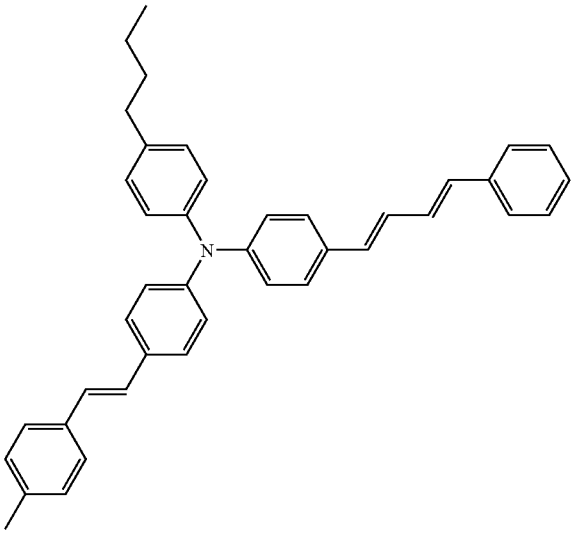

(HTM-7)

(18)

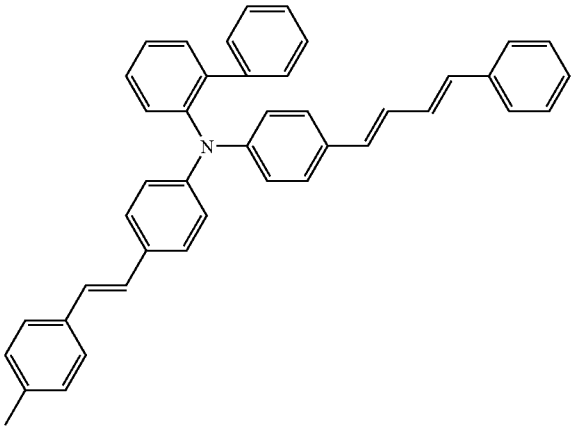

(HTM-8)

(19)

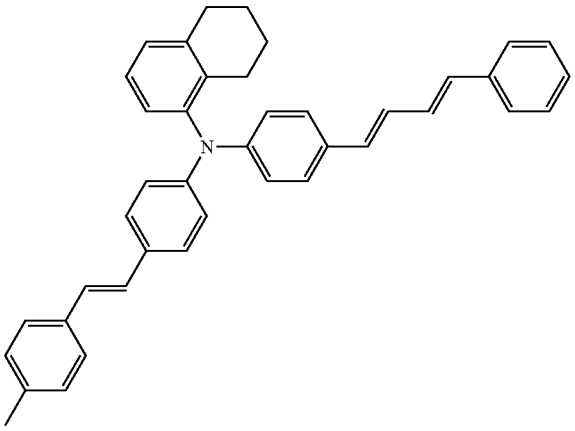

(HTM-9)

-continued (20)

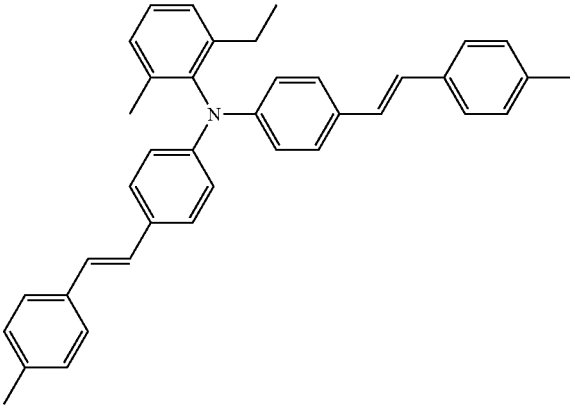

(HTM-10)

The content of the amine compound represented by the general formula (1) is preferably from 10 to 100 parts by mass, more preferably from 20 to 90 parts by mass, and particularly preferably from 30 to 80 parts by mass, based on 100 parts by mass of the binder resin in the photoconductive layer in view of the fact that crystallization of the amine compound in the photoconductive layer is suppressed and high electrical characteristics are obtained.

When the content of the amine compound is too small, sensitivity decreases. In contrast, when the content of the amine compound is too large, the amine compound is easily crystallized and thus there is a tendency that it becomes difficult to form a proper film as the photoconductive layer.

Next, the binder resin used in the photoconductive member of the present embodiment will be described.

In the binder resin used in the photoconductive member of the present embodiment, a IV/OV value in which an inorganic value (IV) is divided by an organic value (OV) of the binder resin is 0.36 or more. By using such a binder resin, since compatibility between the amine compound represented by the general formula (1) having high crystallinity and the binder resin is improved, crystallization of the amine compound in the photoconductive layer can be suppressed, and high dispersibility of the amine compound is obtained in the photoconductive layer. Consequently, when an oil component partially adheres onto the surface of the photoconductive layer, elution of the amine compound is suppressed and thus, generation of cracks is suppressed, thereby allowing black spots to become difficult to generate in the formed image.

The method for calculation of the IV/OV value will now be described.

First, the number (contribution ratio) of each functional group or each bond shown in Table 1 per 1 mol of the subject compound is determined. Referring to Table 1, a value obtained by multiplying each contribution ratio with an organic value or an inorganic value of each functional group or bond is added up with respect to each of the organic value and the inorganic value. At this time, with regard to carbon (C), the organic value is assumed as 20 when the contribution ratio is 1. The resulting added value of the organic value is referred to as 'OV value', while the resulting added value of the inorganic value is referred to as 'IV value'. The IV/OV value is calculated by determining the ratio of the IV value to the OV value.

TABLE 1

| Inorganic Group | Value Inorganic | Organic and Inorganic Group | Value Organic | Value Inorganic |
|---|---|---|---|---|
| Light Metals | 500< | $R_4Bi$—OH | 80 | 250 |
| Heavy Metals, Amine and NH4 salt | 400< | $R_4Sb$—OH | 60 | 250 |
| —$AsO_3H_2$, >$AsO_2H$ | 300 | $R_4As$—CH | 40 | 250 |
| —$SO_2$—NH—CO—, —N═N—$NH_2$ | 260 | $R_4P$—OH | 20 | 250 |
| ⇒$N^+$—OH, —$SO_3H$, —$NHSO_2$—NH | 250 | —O—$SO_3H$ | 20 | 220 |
| —CO—NHCO—NHCO— | 250 | >$SO_2$ | 40 | 170 |
| ->S—OH, —CONH—CONH—CONH—, —$SO_2NH$— | 240 | >SO | 40 | 140 |
| —CS—NH—, —CONH—CO— | 230 | —CSSH | 100 | 80 |
| ═N—OH—, —NHCONH— | 220 | —SCN | 90 | 80 |
| ═N—NH—, —CONH—$NH_2$ | 210 | —CSOH, —COSH | 80 | 80 |
| —CONH— | 200 | —NCS | 90 | 75 |
| ->N->O | 170 | —Bi< | 80 | 70 |
| —COOH | 150 | —$NO_2$ | 70 | 70 |
| Lactone cyclization | 120 | —Sb< | 60 | 70 |
| —CO—O—CO— | 110 | —As<, —CN | 40 | 70 |
| Anthrathene nucleus, Phenanthrene nucleus | 105 | —P< | 20 | 70 |
| —OH | 100 | —CSSϕ | 130 | 50 |
| >Hg (Organic bond) | 95 | —CSOϕ, —COSϕ | 80 | 50 |
| —NH—NH, —O—CO—O— | 80 | —NO | 50 | 50 |
| —N< (—$NH_2$, —NHϕ, —N$ϕ_2$) Amine | 70 | —O—$NO_2$ | 60 | 40 |
| >CO | 65 | —NC | 40 | 40 |
| —COOϕ, Naphthalene nucleus, Quinoline nucleus* | 60 | —Sb═Sb— | 90 | 30 |
| >C═NH | 50 | —As═As— | 60 | 30 |
| —O—O— | 40 | —P═P—, —NCO | 30 | 30 |
| —N═N— | 30 | —O—NO, —SH, —S— | 40 | 20 |
| —O— | 20 | —I | 80 | 10 |
| Benzene nucleus (Aromatic single ring), Pyridine nucleus | 15 | —Br | 60 | 10 |
| Ring (non-aromatic single ring) | 10 | ═S | 50 | 10 |
| Triple bond | 3 | —Cl | 40 | 10 |
| Double bond | 2 | —F | 5 | 5 |
| —($OCH_2CH_2$)—, Sugar ring-O— | 75 | iso ramification>- | −10 | 0 |
| | (20) | tert ramification->- | −20 | 0 |

In Table 1, R represents an alkyl group and ø represents an alkyl group or an aryl group. As is apparent from Table 1, as the IV/OV value decreases, the resulting organic compound shows nonpolarity (hydrophobicity or large organic properties). In contrast, when the IV/OV value increases, the resulting organic compound shows polarity (hydrophilicity or large inorganic properties).

The IV/OV value can be said to be an indicator in which a functional group and a bond of a compound is classified into an organic group which exhibits covalent bonding properties, and an inorganic group which exhibits ionic bonding properties, and an organic compound is located at each one point on a orthogonal coordinates referred to as an organic axis and an inorganic axis. The inorganic value is a value in which the degree of influence of various substituents and bonds of the organic compound on a boiling point is converted into a numerical value based on a hydroxyl group.

Specifically, in the boiling point curve of a linear alcohol and the boiling point curve of a linear paraffin, a difference of boiling point between the boiling point curves is about 100° C. at a carbon atom number of about 5. Therefore, the influence of one hydroxyl group is set at 100 as a numerical value. Based on this numerical value, the influence of various substituents or various bonds on the boiling point is converted into a numerical value which is an inorganic value of a substituent of the organic compound. For example, as shown in Table 1, the inorganic value of a —COOH group is 150 and the inorganic value of a double bond is 2. Therefore, the inorganic value of the organic compound means the sum total of inorganic values of various substituents and bonds of the organic compound.

Such an IV/OV value is also described in detail in documents, for example, KUMAMOTO PHARMACEUTICAL BULLETIN, No. 1, pp 1-16(1954) ; Kagaku-no-Ryoiki, Vol. 11, No. 10, pp 719-725(1957) ; FRAGRANCE JOURNAL, No. 34, pp. 97-111(1979) and FRAGRANCE JOURNAL, No. 50, pp. 79-82(1981).

Specific examples of the binder resin used in the present embodiment include a polycarbonate resin represented by the following general formula (6).

(6)

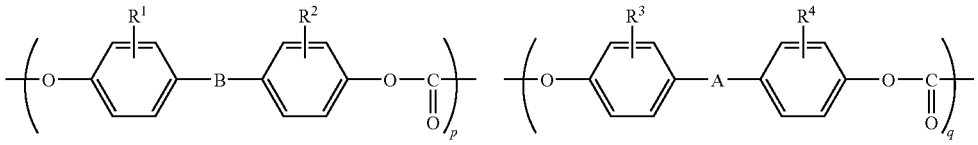

$p + q = 100, 5 < p < 60$ wherein, in the general formula (6), $R^1$ to $R^4$ each independently represents a hydrogen atom, a substituted or unsubstituted alkyl group having 1 to 20 carbon atoms, or a substituted or unsubstituted aryl group having 6 to 30 carbon atoms; A represents —O—, —S—, —CO—, —COO—, —$(CH_2)_2$—, —SO—, —$SO_2$—, —$CR^5R^6$—, —$SiR^5R^6$—, or —$SiR^5R^6$—O— ($R^5$ and $R^6$ each independently represents a hydrogen atom, a substituted or unsubstituted alkyl group having 1 to 8 carbon atoms, a substituted or unsubstituted aryl group having 6 to 30 carbon atoms, or a trifluoromethyl group, or $R^5$ and $R^6$ may be combined to form, as a ring, a cycloalkylidene having 5 to 12 carbon atoms which may have an alkyl group having 1 to 7 carbon atoms as a substituent); B represents a single bond, —O—, or —CO—.

p and q in the general formula (6) represent the molar fraction of copolymerization components. For example, when p is 15 and q is 85, the molar fraction is 15:85. Also, the molar fraction can be measured by NMR.

It is easy to adjust the IV/OV value of the polycarbonate resin within a predetermined range, and stability to an oil component can be improved. Also, it is possible to provide a photoconductive layer having excellent mechanical strength of the polycarbonate resin.

Specific examples of the polycarbonate resin represented by the general formula (6) include polycarbonate resins represented by the following formulas (8) to (10) (Resin-1 to Resin-3).

(8)

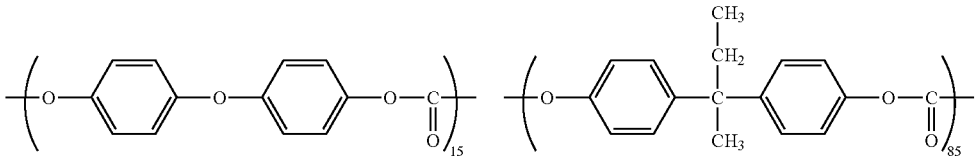

(Resin-1)
IV/OV:O. 3633

The IV/OV value was determined by the following procedure.

In the general formula (8), the contribution ratio of carbon to the organic value is determined as follows: 13(number of carbon)×0.15(molar fraction)+17×0.85=16.4. Also, the contribution ratio of the tertiary branching to the organic value is 0.85. Therefore, the organic value (OV value) is as follows: 16.4×20+0.85×(−20)=311.

The contribution ratio of a benzene ring to the inorganic value is 2 (number of benzene rings), the contribution ratio of —O— to the inorganic value is 0.15, and the contribution ratio of —OCOO— to the inorganic value is 1. Therefore, the inorganic value (IV value) is as follows: 15×2+20×0.15+80×1=113. Consequently, the IV/OV value is as follows: 113/311=0.3633.

(9)

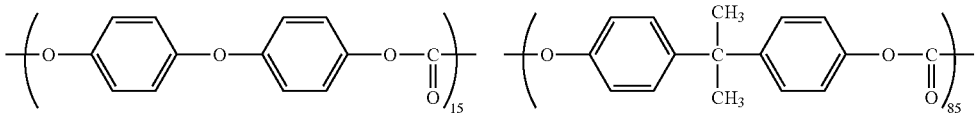

(Resin-2)
IV/OV:O. 384

The IV/OV value was determined by the following procedure.

In the general formula (9), the contribution ratio of carbon to the organic value is determined as follows: 13×0.15+16×0.85=15.55. The contribution ratio of the tertiary branching to organic value is 0.85. Therefore, the organic value (OV value) is as follows: 15.55×20+0.85×(−20)=294.

The contribution ratio of a benzene ring to the inorganic value is 2, the contribution ratio of —O— to the inorganic value is 0.15, and the contribution ratio of —OCOO— to the inorganic value is 1. Therefore, the inorganic value (IV value) is as follows: 15×2+20×0.15+80×1=113. Consequently, the IV/OV value is as follows: 113/294=0.384.

(10)

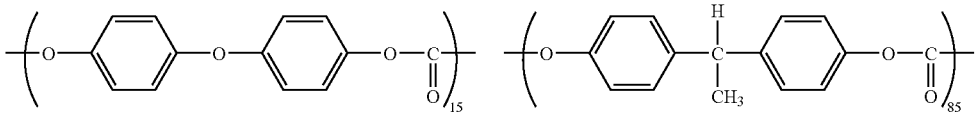

(Resin-3)
IV/OV:O. 396

The IV/OV value was determined by the following procedure.

In the general formula (10), the contribution ratio of carbon to the organic value is as follows: 13×0.15+15×0.85=14.7. The contribution ratio of iso branching to the organic value is 0.85. Therefore, the organic value (OV value) is as follows: 14.7×20+0.85×(−10)=285.5.

The contribution ratio of a benzene ring to the inorganic value is 2, the contribution ratio of —O— to the inorganic value is 0.15, and the contribution ratio of —OCOO— to the inorganic value is 1. Therefore, the inorganic value (IV value) is as follows: 15×2+20×0.15+80×1=113. Consequently, the IV/OV value is as follows: 113/285.5=0.396.

The viscosity average molecular weight of the binder resin used in the present embodiment is preferably within a range from 10,000 to 60,000, more preferably from 20,000 to 50,000, and particularly preferably from 30,000 to 40,000. When the viscosity average molecular weight is adjusted within the above range, stability to an oil component can be more improved and also compatibility between the binder resin and the hole transferring material having a specific structure can be improved. When the viscosity average molecular weight is too low, the oil component is easily permeates into the surface of the photoconductive layer and thus there is a tendency that cracks are easily generated. In contrast, when the viscosity average molecular weight is too high, viscosity of a coating solution remarkably increases, and thus compatibility with the hole transferring material decreases and it may becomes difficult to perform uniform dispersion.

The viscosity average molecular weight of the binder resin can be determined by the following procedure. Namely, the intrinsic viscosity [η] is determined by an Ostwald viscometer and then the viscosity average molecular weight is calculated from $[\eta]=1.23\times10^{-4}M^{0.83}$ by Schnell's equation. [η] can be measured using a binder resin solution obtained by dissolving a binder resin in a methylene chloride solution as a solvent at 20° C. in a concentration (C) of 6.0 g/dm$^3$.

Figure 2:
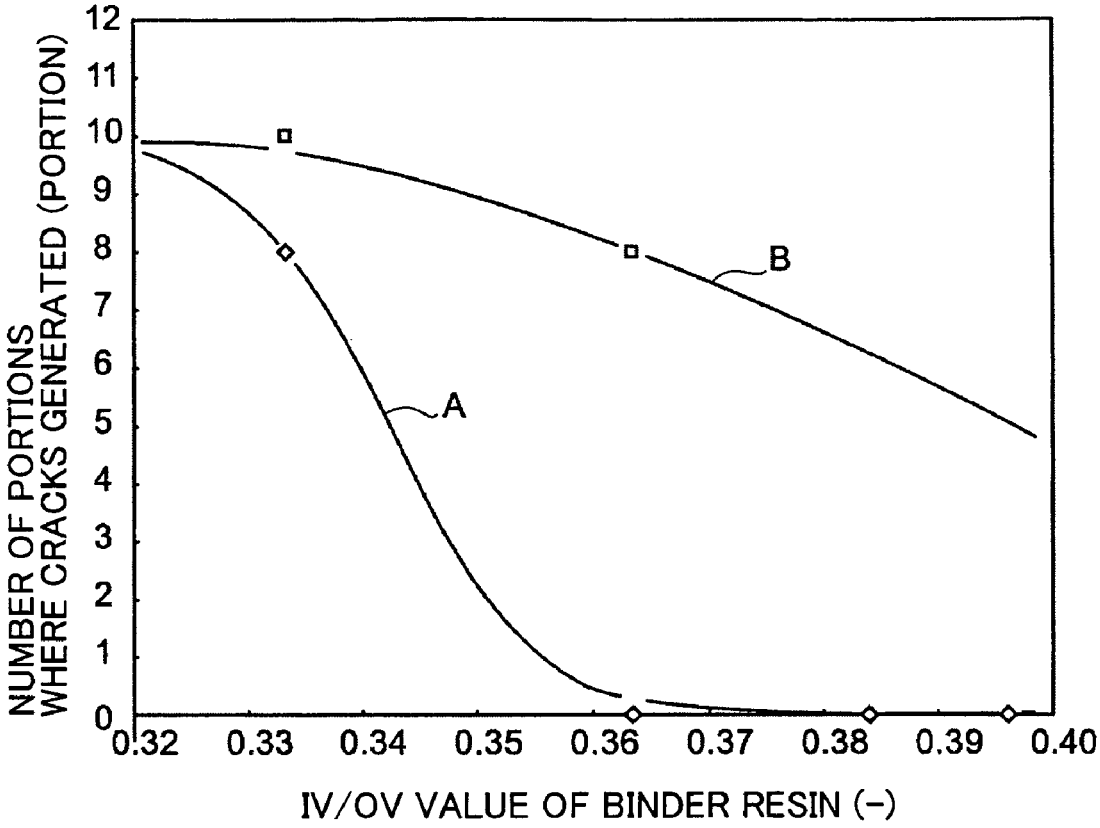
FIG. 2 is a graph showing a relation between the IV/OV value of a binder resin and the number of generated cracks.

FIG. 2 is a graph showing an example of the evaluation results of a relation between the IV/OV value of a binder resin and the number of generated cracks in a photoconductive member. The abscissa axis indicates the IV/OV value (–) of the binder resin, whereas, the vertical axis indicates the number of generated cracks (the number of generated positions) of a photoconductive member including a photoconductive layer which contains a binder resin having each IV/OV value.

In FIG. 2, a curve A shows a relation between the IV/OV value of a binder resin and the number of generated cracks in a photoconductive member when an amine compound (HTM-1) represented by the formula (11) included in the general formula (1) is used as the hole transferring material, while a curve B shows a relation between the IV/OV value of a binder resin and the number of generated cracks in a photoconductive member when a compound (HTM-11) represented by the following formula (32), which is not the amine compound represented by the general formula (1), is used as the hole transferring material.

(32)

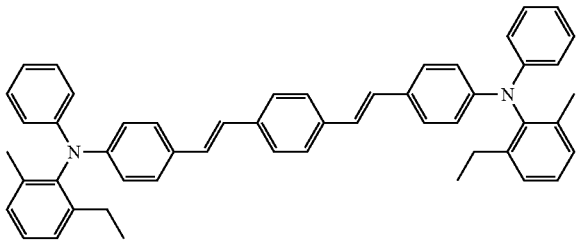

(HTM-11)

At this time, as the binder resin, polycarbonate resins represented by the formulas (8) to (10) and (31) (Resin-1 to Resin-4) were used. As the constitution of the photoconductive member and the evaluation of generation of cracks, the same constitution and evaluation method as in the Examples described hereinafter were used.

First, as is apparent from the curve A in which the amine compound (HTM-1) represented by the general formula (11) was used, the number of generated cracks decreases when the IV/OV value of the binder resin increases. More specifically, when the IV/OV value of the binder resin increased from 0.32 to 0.36, the number of generated cracks drastically decreases from about 10 to about 0. When the IV/OV value is 0.36 or more, the number of generated cracks is around 0. As described above, when the amine compound (HTM-1) represented by the formula (11) included in the general formula (1) is used as the hole transferring material, generation of cracks can be sufficiently suppressed by using a binder resin having an IV/OV value of 0.36 or more.

As is also apparent from the curve B in which the compound (HTM-11) represented by the formula (32) which is not included in the general formula (1) was used, the number of generated cracks decreases when the IV/OV value of the binder resin increases. However, the decrease in the number of generated cracks is very small as compared with the curve A. More specifically, when the IV/OV value of the binder resin increased from 0.32 to 0.36, the number of generated cracks only decreases from about 10 to about 8.

As is apparent from the above results, in case of using the amine compound (HTM-1) represented by the general formula (1), generation of cracks can be remarkably suppressed by using a binder resin having an IV/OV value of 0.36 or more.

Thus, even if the IV/OV value of the binder resin is limited, the crack suppression effect drastically varies according to the kind of hole transferring material to be used. It is considered that this varies depending on solubility of the hole transferring material to an oil component, and crystallinity of the hole transferring material.

Next, the electron transferring material used in the photoconductive member of the present embodiment will be described. It is possible to use, as the electron transferring material used in the photoconductive member of the present embodiment, conventionally known electron transferring materials without any limitation. Examples of the electron transferring material include diphenoquinone derivatives, pyrene derivatives, benzoquinone derivatives, anthraquinone derivatives, malononitrile derivatives, thiopyran derivatives, trinitrothioxanethone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracyanoethylene, 2,4,8-trinitrothioxanethone, dinitrobenzene, dinitroanthracene, dinitroacridine, nitroanthraquinone, dinitroanthraquinone, succinic anhydride, maleic anhydride, and dibromomaleic anhydride. These electron transferring materials may be used alone, or two or more kinds of them may be used in combination.

As the electron transferring material, compounds (ETM-1 to ETM-3) represented by the following formulas (21) to (23) are used preferably.

(21)

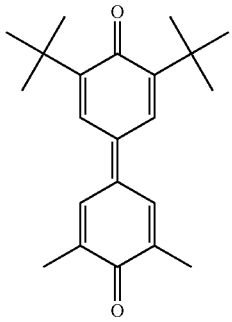

(ETM-1)

(22)

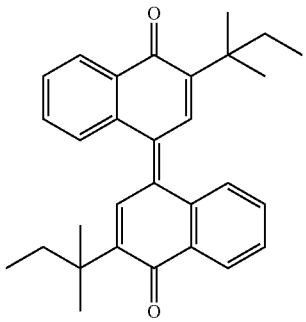

(ETM-2)

(23)

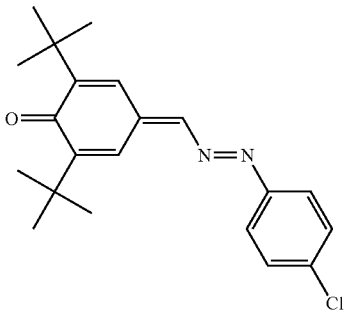

(ETM-3)

The content of the electron transferring material is preferably within a range from 10 to 100 parts by mass, and more preferably from 20 to 80 parts by mass, based on 100 parts by mass of the binder resin. When the content of the electron transferring material is too small, sensitivity tends to decrease. In contrast, when the content is too large, the electron transferring material is easily crystallized and thus there is a tendency that it becomes difficult to form a proper photoconductive layer.

It is preferred to set the content of the electron transferring material taking account of the content of the hole transferring material (HTM). Specifically, the ratio of the electron transferring material (ETM) (entire ETM/entire HTM) is preferably adjusted within a range from 0.25 to 1.3, and more preferably from 0.5 to 1.25 in view of the fact that sufficient sensitivity is obtained.

Next, the charge generating material used in the photoconductive member of the present embodiment will be described.

It is possible to use, as the charge generating material used in the photoconductive member of the present embodiment, conventionally known charge generating materials without any limitation. Examples of the charge generating material include organic photoconductors such as phthalocyanine-based pigments, perylene-based pigments, bisazo pigments, dioketopyrrolopyrrole pigments, metal-free naphthalocyanine pigments, metal naphthalocyanine pigments, squaraine pigments, trisazo pigments, indigo pigments, azulenium pigments, cyanine pigments, pyrylium pigments, anthanthrone pigments, triphenylmethane-based pigments, threne pigments, toluidine-based pigments, pyrazoline-based pigments, and quinacridon-based pigments; and inorganic photocondutors such as selenium, selenium-tellurium, selenium-arsenic, cadmium sulfide, and amorphous silicone. These charge generating materials may be used alone, or two or more kinds of them may be used in combination.

As the charge generating material, phthalocyanine-based pigments (CGM-A to CGM-D) represented by the following formulas (24) to (27) are used preferably.

(24)

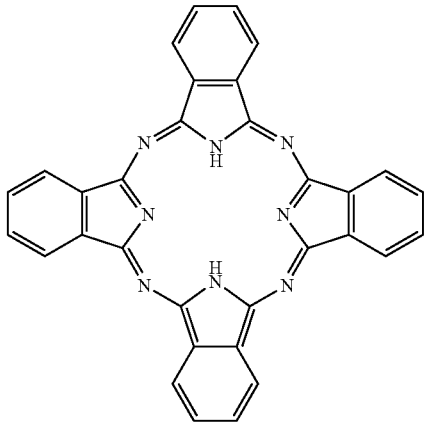

(CGM-A)

(25)

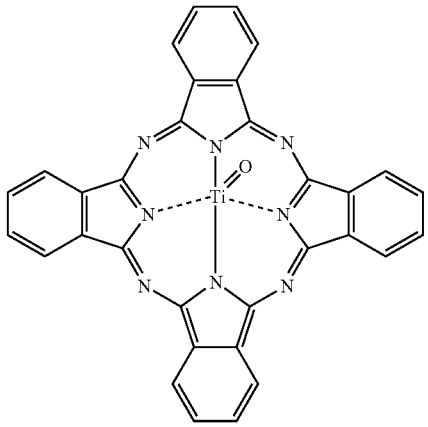

(CGM-B)

-continued (26)

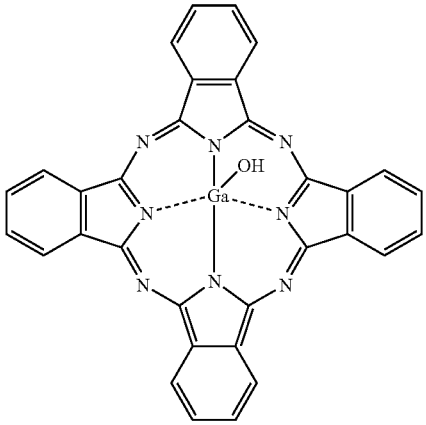

(CGM-C)

(27)

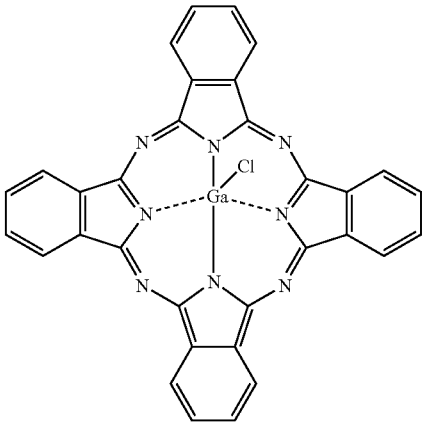

(CGM-D)

The content of the charge generating material is preferably within a range from 0.2 to 40 parts by mass, and more preferably from 0.5 to 20 parts by mass, based on 100 parts by mass of the binder resin. When the content of the charge generating material is too small, the effect of enhancing the quantum yield becomes insufficient and thus sensitivity, electrical characteristics and stability of the photoconductive member become insufficient. In contrast, when the content of the charge generating material is too large, the effect of increasing the absorbance index to light having a wavelength in the red range, the near infrared range, or the infrared range in visible light becomes insufficient and thus sensitivity characteristics, electrical characteristics and stability of the photoconductive member tend to become insufficient.

Also, the photoconductive layer contains, as an additive, a compound represented by the following general formula (7):

(7)

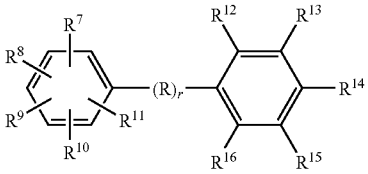

wherein, in the general formula (7), $R^7$ to $R^{16}$ each independently represents a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 6 to 30 carbon atoms, a substituted or unsubstituted cycloalkyl group having 3 to 12 carbon atoms, a hydroxyl group, a cyano group, a nitro group, or an amino group; R represents a substituted or unsubstituted alkylene group having 1 to 12 carbon atoms or an organic group containing a nitrogen atom; and the repeating number r represents an integer of 0 to 3.

The additive serves as a plasticizer and generation of cracks can be more suppressed by this action as a plasticizer. Namely, when the additive is added, even if the amino compound as the charge transferring material is eluted in the oil component to form voids in the photoconductive layer, generation of cracks can be suppressed by relieving stress in the vicinity of the voids by the action of the plasticizer.

Specific examples of the additive include compounds (P-1 to P-3) represented by the following formulas (28) to (30).

(28)

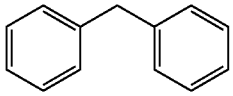

(P-1)

(29)

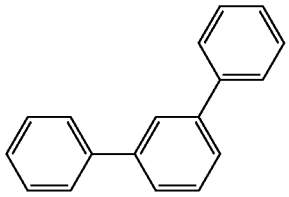

(P-2)

(30)

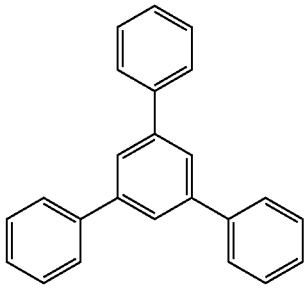

(P-3)

The content of the additive is preferably within a range from 1.5 to 14 parts by mass, more preferably from 2 to 12 parts by mass, and particularly preferably from 3 to 10 parts by mass, based on 100 parts by mass of the binder resin in the photoconductive layer.

When the content of the additive is too small, the stress relieving effect becomes insufficient and generation of cracks cannot be sufficiently suppressed. In contrast, when the content is too large, the glass transition point of the photoconductive layer excessively decreases and thus abrasion resistance decreases, and furthermore, the additive is crystallized and dispersibility in the binder resin tends to decrease.

The photoconductive layer may contain various conventionally known additives, for example, antideteriorating agents such as antioxidants, radical scavengers, singlet quenchers, and ultraviolet absorbers; softeners; plasticizers; surface modifiers; extending agents; thickeners; dispersion stabilizers; waxes; acceptors; and donors as long as the effects of the present invention are not adversely affected. The photoconductive layer may contain known sensitizers such as terphenyl, halonaphthoquinones, and acenaphthylene so as to improve sensitivity of the photoconductive layer.

The thickness of the photoconductive layer is preferably within a range from 5 to 100 μm, more preferably from 10 to 50 μm, and particularly preferably from 15 to 45 μm. When the thickness of the photoconductive layer is too small, it may become difficult to uniformly form the photoconductive layer and the mechanical strength may decrease. In contrast, when the thickness of the photoconductive layer is too large, the photoconductive layer tends to separate from the substrate.

Next, a method for producing a single-layered photoconductive member of the present embodiment will be described.

The method for producing a single-layered photoconductive member may be a conventionally known method and is not specifically limited. Specifically, the following method is employed.

First, a predetermined solvent is mixed with the charge transferring material containing the hole transferring material, a charge generating material, the binder resin and an additives to prepare a coating solution. The coating solution thus prepared is coated on the surface of a conductive base material (for example, an aluminum tube) using a coating method such as a dip coating method, a spray coating method, a bead coating method, a blade coating method, or a roller coating method. Then, for example, the coated conductive base material is hot air-dried at 100° C. for 30 minutes to obtain a single-layered photoconductive member with a photoconductive layer having a predetermined thickness.

As the solvent, various organic solvents can be used. Specific examples thereof include alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ethers such as dimethylether, diethylether, tetrahydrofuran, ethylene glycol dimethyl ether, diethylene glycol dimethyl ether, 1,3-dioxolane, and 1,4-dioxane; ketones such as acetone, methyl ethyl ketone, and cyclohexanone; esters such as ethyl acetate and methyl acetate; dimethylformaldehyde; dimethylformamide; and dimethyl sulfoxide. These solvents may be used alone, or two or more kinds of them may be used in combination. At this time, the coating solution may contain surfactants and leveling agents so as to improve dispersibility of the respective components and smoothness of the photoconductive layer.

When forming an intermediate layer as shown in FIG. 1B, before forming the photoconductive layer, the intermediate layer is preliminarily formed on the surface of a substrate.

In case of forming the intermediate layer, first, a binder resin and, if necessary, additives (organic fine powders or inorganic fine powders) are mixed with a proper dispersion medium, followed by dispersion and mixing using a known dispersing method such as a roll mill, a ball mill, an atriter, a paint shaker, or an ultrasonic disperser to prepare a coating solution.

The additives are added for the purpose of preventing generation of interference fringe as a result of light scattering. The additives can be added in a small amount so that sedimentation does not arise in the case of preparing the coating solution.

As the solvent, various organic solvents can be used. Specific examples thereof include alcohols such as methanol, ethanol, isopropanol, and butanol; aliphatic hydrocarbons such as n-hexane, octane, and cyclohexane; aromatic hydrocarbons such as benzene, toluene, and xylene; halogenated hydrocarbons such as dichloromethane, dichloroethane, chloroform, carbon tetrachloride, and chlorobenzene; ketones such as acetone, methyl ethyl ketone, and cyclohexanone; esters such as ethyl acetate and methyl acetate; dimethylformaldehyde; dimethylformamide; and dimethyl sulfoxide. These solvents may be used alone, or two or more kinds of them may be used in combination.

The resulting coating solution is coated on the surface of a substrate (for example, an aluminum tube) using a known coating method such as a dip coating method, a blade coating method, a bead coating method, a roller coating method, or a spray coating method and subjected to a heat treatment to form an intermediate layer. The heat treatment is preferably conducted at a temperature of 20 to 200° C. for 5 minutes to 2 hours.

Second Embodiment

Multi-Layered Photoconductive Member

Hereinafter, a multi-layered photoconductive member according to the second embodiment of the present invention will be described. In the present embodiment, portions different from those of the first embodiment are mainly described and descriptions of other portions are omitted because they are the same as those of the single-layered photoconductive member according to the first embodiment.

Figure 3A:
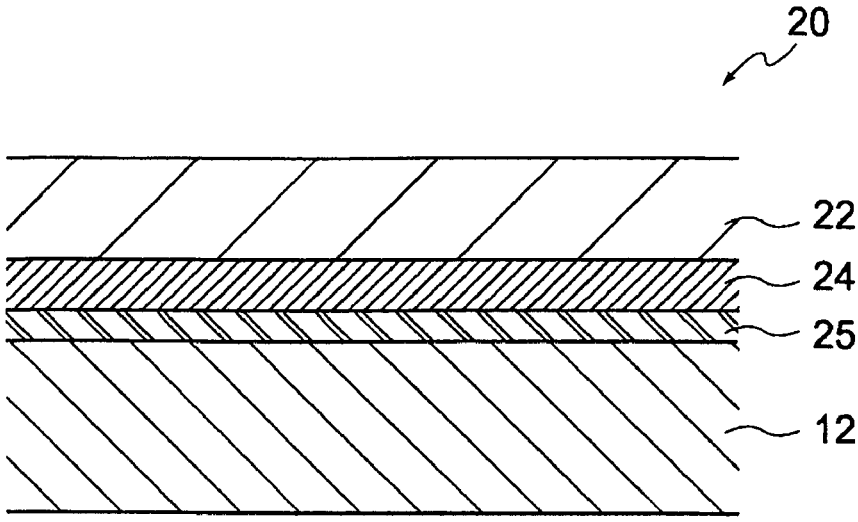
FIG. 3A is a schematic cross-sectional view showing a layered structure of a multi-layered electrophotographic photoconductive member according to a second embodiment.

FIG. 3A is a schematic sectional view showing a multi-layered photoconductive member 20 including a substrate 12, and an intermediate layer 25, a charge generating layer 24 and a charge transferring layer 22 containing the hole transferring material, which are sequentially laminated from the surface side of the substrate 12.

The multi-layered photoconductive member 20 is obtained by, after forming the intermediate layer 25 on the surface of the substrate 12, forming the charge generating layer 24 containing a charge generating material using a means such as vapor deposition or coating, coating a coating solution containing a charge transferring material containing the hole transferring material and the binder resin on the surface of the charge generating layer 24, drying the coating solution, and forming the charge transferring layer 22.

Figure 3B:
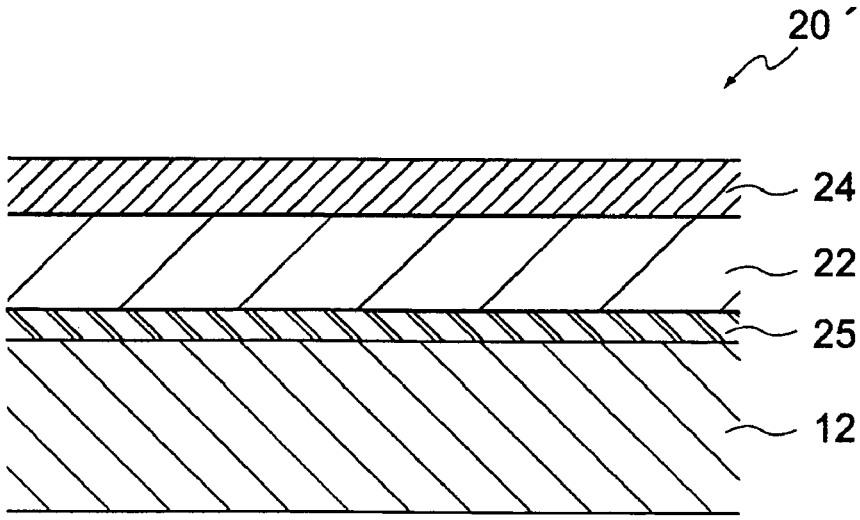
FIG. 3B is a schematic cross-sectional view showing a layered structure of another multi-layered electrophotographic photoconductive member according to the second embodiment.

FIG. 3B is a schematic sectional view showing a multi-layered photoconductive member 20' as a modified example in which the sequence of lamination of the charge transferring layer 22 and the charge generating layer 24 was made to be different from that in the multi-layered photoconductive member 20 in FIG. 3A.

Since the charge generating layer 24 has a small thickness as compared with the charge transferring layer 22, the aspect in which the charge transferring layer 22 is formed on the charge generating layer 24 shown in FIG. 3A is more preferred so as to protect the charge generating layer 24.

The multi-layered photoconductive member is preferred in view of the high degree of freedom of design because the range of selection of photoconductive materials such as a charge generating material and a charge transferring material is widened.

The multi-layered photoconductive member is classified into a positive charging type or negative charging type photoconductive member according to the sequence of formation of the charge generating layer and the charge transferring layer and the kind of charge transferring material used in the charge transferring layer. For example, when a charge generating layer is formed on a substrate and a charge transferring layer is formed thereon, and a hole transferring material composed of the amino compound represented by the general formula (1) is used as the charge transferring material of the charge transferring layer, a negative charging type photoconductive member is obtained. In this case, the charge generating layer may contain an electron transferring material.

The coating solution for forming a charge generating layer is prepared by mixing a charge generating material, a binder resin and other additives used according to necessity in a dispersion medium, followed by dispersion and mixing. Also, the coating solution for forming a charge transferring layer is prepared by mixing a charge transferring material containing the hole transferring material, the binder resin and other additives used according to necessity in a dispersion medium, followed by dispersion and mixing. Dispersion and mixing are conducted using a roll mill, a ball mill, an atriter, a paint shaker, or an ultrasonic disperser.

The content of the hole transferring material composed of the amino compound represented by the general formula (1) is preferably within a range from 10 to 500 parts by mass, and more preferably from 25 to 200 parts by mass, based on 100 parts by mass of the binder resin in the charge transferring layer in view of the fact that crystallization in the charge transferring layer is suppressed to attain excellent electrical characteristics. When the content of the hole transferring material is too small, sensitivity tends to decease. In contrast, when the content of the hole transferring material is too large, the hole transferring material is easily crystallized and thus there is a tendency that is becomes difficult to form a proper film as a charge transferring layer.

When the charge transferring layer contains an electron transferring material, the content of the electron transferring material is preferably within a range from 5 to 200 parts by mass, and more preferably from 10 to 100 parts by mass, based on 100 parts by mass of the binder resin in the charge transferring layer.

Furthermore, the content of the charge generating material in the charge generating layer is preferably within a range from 5 to 1,000 parts by mass, and more preferably from 30 to 500 parts by mass, based on 100 parts by mass of the binder resin in the charge generating layer.

The thickness of the charge generating layer 24 is not specifically limited, but is preferably within a range from 0.01 to 5 μm, and more preferably from 0.1 to 3 μm. Also, the thickness of the charge transferring layer 22 is not specifically limited, but is preferably within a range from 2 to 100 μm, and more preferably from 5 to 50 μm.

Third Embodiment

Image Forming Apparatus

A third embodiment pertains to an image forming apparatus comprising the photoconductive member according to the first embodiment or the second embodiment, wherein at least a charger device, a developing device and a transfer roller device are arranged around the photoconductive member and also any one of the device is arranged in contact with the photoconductive member.

Hereinafter, an image forming apparatus of the third embodiment will be described mainly about points which are different from those described in the first embodiment and the second embodiment.

Figure 4:
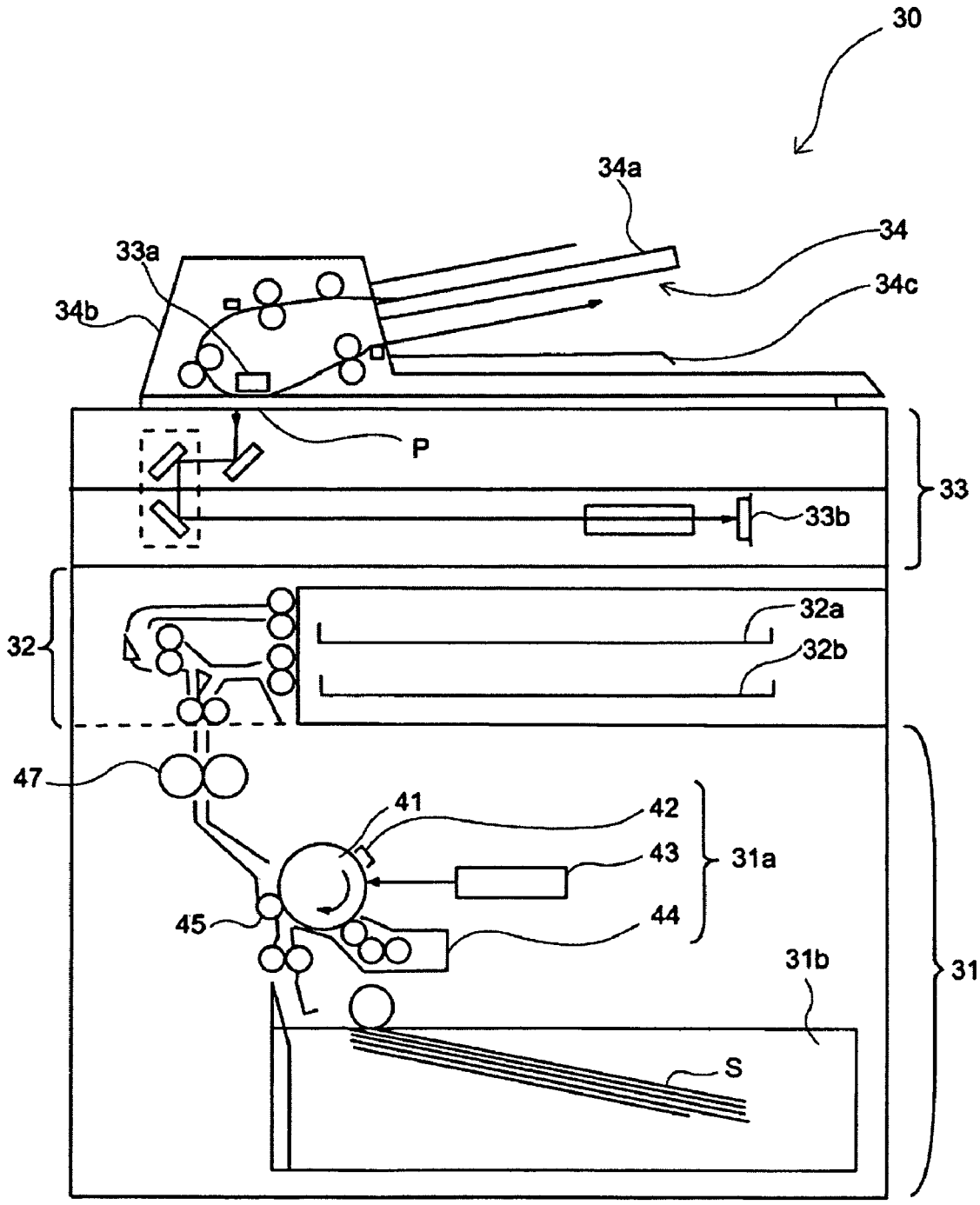
FIG. 4 is a schematic diagram for explaining a constitution of an image forming apparatus equipped with the electrophotographic photoconductive member according to the first embodiment or the second embodiment.

FIG. 4 is a schematic view for explaining an example of the constitution of a copying machine 30 as an example of the image forming apparatus according to the third embodiment.

The copying machine 30 is equipped with an image forming unit 31, a paper discharge unit 32, an image reading unit 33 and an original document supplying unit 34. Also, the image forming unit 31 is equipped with an image forming portion 31*a* and a paper supplying portion 31*b*. The original document supplying unit 34 includes an original document replacing tray 34*a*, an original document supplying mechanism 34*b* and an original document discharging tray 34*c*. An original document placed on the original document replacing tray 34*a* is sent to an image reading location P through the original document supplying mechanism 34*b*, and then discharged to the original document discharging tray 34*c*.

At the stage where the original document is sent to the original document reading location P, an image on the original document is read in the image reading unit 33 utilizing light from a light source 33*a*. Using an optical element 33*b* such as CCD, an image signal corresponding to the image on the original document is formed.

A recording paper (hereinafter referred to simply as paper) S laid on the supplying portion 31*b* is sent to the image forming portion 31*a*. This image forming portion 31*a* is equipped with a photoconductive drum 41 (photoconductive member) as an image carrier. Around the photoconductive member drum 41, a charger 42, an exposing device 43, a developing device 44 and a transfer roller 45 are arranged along a rotation direction of the photoconductive member drum 41. The photoconductive drum 41 adopts the photoconductive member of the first embodiment or the second embodiment.

The photoconductive member drum 41 is rotatably driven in the direction indicated by the arrow in the drawing and the surface thereof is uniformly charged by the charger 42. Then, the photoconductive member drum 41 is subjected to an exposure process by the exposing device 43 based on the image signal to form an electrostatic latent image on the surface of the photoconductive drum 41.

Based on the electrostatic latent image, the development is conducted by supplying a toner on the surface of the photoconductive drum 41 using the developing device 44, and thus a toner image is formed. The toner image is transferred, as a transfer image, to the paper S, which is conveyed to a nip portion between the photoconductive drum 41 and the transfer roller 45. Then, the paper S on which the transfer image was transferred is conveyed to the fixing unit 47, where the fixing process is conducted.

The image forming apparatus of the third embodiment is characterized by using the photoconductive member described as the photoconductive drum 41 in the first embodiment or the second embodiment. The image forming apparatus of the third embodiment is also characterized in that at least one element of the charger 42, the developing device 44 and the transfer roller 45 is brought into contact with the photoconductive drum 41.

After fixation, the paper S is sent to the paper discharge unit 32. When a post-treatment (for example, a staple treatment) is conducted, the paper S is sent to an intermediate tray 32*a* and then subjected to a post-treatment. Then, the paper S is discharged to a discharge tray portion (not shown) provided on the side of the image forming apparatus. When the post-treatment is not conducted, the paper S is discharged to a discharge tray 32*b* provided under the intermediate tray 32*a*. The intermediate tray 32*a* and the discharge tray 32*b* are constituted as a so-called in-drum paper discharge portion.

Generation of cracks tends to be promoted by applying a mechanical force when the charger, the developing device or the transfer roller is brought into contact with the photoconductive layer. According to the image forming apparatus, generation of cracks can be effectively suppressed even with such a constitution that a mechanical force is applied to the photoconductive layer by disposing the charger in contact with the photoconductive member.

Furthermore, since the mounted photoconductive member has excellent electrical characteristics, a high quality image with suppressed black spots is efficiently formed.

EXAMPLES

Example 1

Production of Electrophotographic Photoconductive Member

In a vessel, 3 parts by mass of an X-type metal-free phthalocyanine (CGM-A) represented by the formula (24) as a charge generating material, 60 parts by mass of a compound (HTM-1) represented by the formula (11) as a hole transferring material, 30 parts by mass of a compound (ETM-1) represented by the formula (21) as an electron transferring material, 100 parts by mass of a polycarbonate resin (Resin-1) having a viscosity average molecular weight of 30,000 represented by the formula (8) as a binder resin and 800 parts by mass of tetrahydrofuran as a solvent were charged.

Next, the composition charged was mixed and dispersed for 50 hours using a ball mill to obtain a coating solution for a single-layered photoconductive layer. The resulting coating solution was coated on the surface of a substrate (aluminum tube) measuring 254 mm in length and a diameter of 16 mm by a dip coating method and then dried by hot air under the conditions of a temperature of 100° C. for 40 minutes to obtain a single-layered photoconductive member having a 25 μm thick single-layered photoconductive layer.

(Evaluation of Photoconductive Member)

(Evaluation of Generation of Cracking)

Generation of cracks of the resulting photoconductive member was evaluated by the following procedure.

Sebum derived from the human hand was adhered on the surface of the resulting photoconductive member by directly touching the surface at random 10 positions and then the photoconductive member was allowed to stand for 3 days. Using an optical microscope, the state of generation of cracks at each position was confirmed and evaluation was conducted according to the following criteria. The results are shown in Table 2.

A: No cracks generated.

B: Cracking generated at 1 to 3 positions.

C: Cracking generated at 4 positions or more.

(Evaluation of Generation of Black Spots)

Black spots of an image forming apparatus equipped with the resulting photoconductive member were evaluated according to the following criteria.

The resulting photoconductive member was mounted in a printer (DP-560, manufactured by KYOCERA MITA Corp.) and 5,000 sheets were continuously printed on A4 size paper (high-quality PPC paper, manufactured by Fuji Xerox Co., Ltd.) under environmental conditions of a temperature of 40° C. and a humidity of 90% Rh. Standing for 6 hours thereafter, a blank original document was printed on A4 size paper and the number of black spots generated on the A4 size paper was counted. The evaluation was conducted according to the following criteria. The results are shown in Table 2.

A: Number of black spots is less than 20 per one A4 size paper.

B: Number of black spots is 20 or more and less than 100 per one A4 size paper.

C: Number of black spots is 100 or more and less than 200 per one A4 size paper.

D: Number of black spots is 200 or more per one A4 size paper.

(Evaluation of Electrical Characteristics)

Sensitivity of the resulting photoconductive member was measured under the following conditions.

Using a drum sensitivity testing machine (manufactured by GENTEC Co., Ltd.), monochromatic light (half peak width: 20 nm, light intensity: 0.6 $\mu J/cm^2$) having a wavelength of 780 nm derived from white light of a halogen lamp using a band pass filter was irradiated on the surface of the photoconductive member at 50 msec in a state where the surface potential of the photoconductive member is charged to +700 V. Next, the surface potential after 0.35 seconds have passed since the beginning of exposure was measured as a bright potential (V). The results are shown in Table 2.

Example 2

In Example 2, a photoconductive member was produced in the same manner as in Example 1, except that a polycarbonate resin (Resin-2) represented by the formula (9) was used as the binder resin of the photoconductive layer in place of the polycarbonate resin (Resin-1) represented by the formula (8) and then evaluated. The results are shown in Table 2.

Example 3

In Example 3, a photoconductive member was produced in the same manner as in Example 1, except that a polycarbonate resin (Resin-3) represented by the formula (10) was used as the binder resin of the photoconductive layer in place of the polycarbonate resin (Resin-1) represented by the formula (8), and then evaluated. The results are shown in Table 2.

Examples 4 to 6

In Examples 4 to 6, photoconductive members were produced in the same manner as in Examples 1 to 3, except that a compound (HTM-2) represented by the formula (12) was used as the hole transferring material in place of the compound (HTM-1) represented by the formula (11) and a compound (ETM-2) represented by the formula (22) was used as the electron transferring material in place of the compound (ETM-1) represented by the formula (21), and then evaluated. The results are shown in Table 2.

Examples 7 to 9

In Examples 7 to 9, photoconductive members were produced in the same manner as in Examples 1 to 3, except that a compound (HTM-3) represented by the formula (13) was used as the hole transferring material in place of the compound (HTM-1) represented by the formula (11) and a compound (ETM-3) represented by the formula (23) was used as the electron transferring material in place of the compound (ETM-1) represented by the formula (21), and then evaluated. The results are shown in Table 2.

Example 10

In Example 10, a photoconductive member was produced in the same manner as in Example 1, except that a compound (HTM-4) represented by the formula (14) was used as the hole transferring material in place of the compound (HTM-1) represented by the formula (11), and then evaluated. The results are shown in Table 2.

Example 11

In Example 11, a photoconductive member was produced in the same manner as in Example 1, except that a compound (HTM-5) represented by the formula (15) was used as the hole transferring material in place of the compound (HTM-1) represented by the formula (11), and then evaluated. The results are shown in Table 2.

Example 12

In Example 12, a photoconductive member was produced in the same manner as in Example 1, except that a compound (HTM-6) represented by the formula (16) was used as the hole transferring material in place of the compound (HTM-1) represented by the formula (11), and then evaluated. The results are shown in Table 2.

Example 13

In Example 13, a photoconductive member was produced in the same manner as in Example 1, except that a compound (HTM-7) represented by the formula (17) was used as the hole transferring material in place of the compound (HTM-1) represented by the formula (11), and then evaluated. The results are shown in Table 2.

Example 14

In Example 14, a photoconductive member was produced in the same manner as in Example 1, except that a compound (HTM-8) represented by the formula (18) was used as the hole transferring material in place of the compound (HTM-1) represented by the formula (11), and then evaluated. The results are shown in Table 2.

Example 15

In Example 15, a photoconductive member was produced in the same manner as in Example 1, except that a compound (HTM-9) represented by the formula (19) was used as the hole transferring material in place of the compound (HTM-1) represented by the formula (11), and then evaluated. The results are shown in Table 2.

Example 16

In Example 16, a photoconductive member was produced in the same manner as in Example 1, except that a compound (HTM-10) represented by the formula (20) was used as the hole transferring material in place of the compound (HTM-1) represented by the formula (11), and then evaluated. The results are shown in Table 2.

Comparative Example 1

In Comparative Example 1, a photoconductive member was produced in the same manner as in Example 1, except that a polycarbonate resin (Resin-4) represented by the following formula (31) was used as the binder resin of the photoconductive layer in place of the polycarbonate resin (Resin-1) represented by the formula (8), and then evaluated. The results are shown in Table 2.

(31)

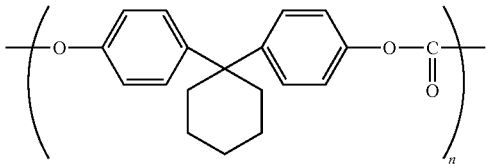

(Resin-4)
IV/OV:O. 3333

Comparative Example 2

In Comparative Example 2, a photoconductive member was produced in the same manner as in Example 4, except that a polycarbonate resin (Resin-4) represented by the formula (31) was used as the binder resin of the photoconductive layer in place of the polycarbonate resin (Resin-1) represented by the formula (8), and then evaluated. The results are shown in Table 2.

Comparative Example 3

In Comparative Example 3, a photoconductive member was produced in the same manner as in Example 7, except that a polycarbonate resin (Resin-4) represented by the formula (31) was used as the binder resin of the photoconductive layer in place of the polycarbonate resin (Resin-1) represented by the formula (8), and then evaluated. The results are shown in Table 2.

Comparative Example 4

In Comparative Example 4, a photoconductive member was produced in the same manner as in Example 1, except that a compound (HTM-11) represented by the following formula (32) was used as the hole transferring material in place of the compound (HTM-1) represented by the formula (11), and then evaluated. The results are shown in Table 2.

(32)

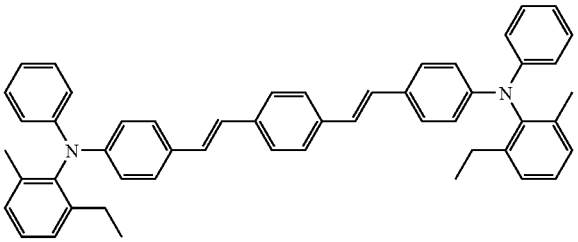

(HTM-11)

Comparative Example 5

In Comparative Example 5, a photoconductive member was produced in the same manner as in Comparative Example 4, except that a polycarbonate resin (Resin-4) represented by the formula (31) was used as the binder resin of the photoconductive layer in place of the polycarbonate resin (Resin-1) represented by the formula (8), and then evaluated. The results are shown in Table 2.

TABLE 2

| | HOLE TRANSFERRING MATERIAL | ELECTRON TRANSFERRING MATERIAL | BINDER RESIN KIND | BINDER RESIN IV/OV VALUE(—) | EVALUATION OF GENERATION OF CRACKS: NUMBER OF PORTIONS WHERE CRACKS GENERATED (PORTION) | EVALUATION OF GENERATION OF CRACKS: RESULTS | EVALUATION OF GENERATION OF BLACK SPOTS: NUMBER OF BLACK SPOTS GENERATED | EVALUATION OF GENERATION OF BLACK SPOTS: RESULTS | EVALUATION OF ELECTRICAL CHARACTERISTICS BRIGHT POTENTIAL (V) |
|---|---|---|---|---|---|---|---|---|---|
| EXAMPLE 1 | HTM-1 | ETM-1 | Resin-1 | 0.3633 | 0 | A | 35 | B | 161 |
| EXAMPLE 2 | | | Resin-2 | 0.3840 | 0 | A | 31 | B | 162 |
| EXAMPLE 3 | | | Resin-3 | 0.3960 | 0 | A | 35 | B | 160 |
| EXAMPLE 4 | HTM-2 | ETM-2 | Resin-1 | 0.3633 | 0 | A | 23 | B | 156 |
| EXAMPLE 5 | | | Resin-2 | 0.3840 | 0 | A | 15 | A | 158 |
| EXAMPLE 6 | | | Resin-3 | 0.3960 | 0 | A | 25 | B | 156 |
| EXAMPLE 7 | HTM-3 | ETM-3 | Resin-1 | 0.3633 | 0 | A | 33 | B | 162 |
| EXAMPLE 8 | | | Resin-2 | 0.3840 | 0 | A | 28 | B | 161 |
| EXAMPLE 9 | | | Resin-3 | 0.3960 | 0 | A | 30 | B | 158 |
| EXAMPLE 10 | HTM-4 | ETM-1 | Resin-1 | 0.3633 | 0 | A | 46 | B | 165 |
| EXAMPLE 11 | HTM-5 | | | | 0 | A | 53 | B | 164 |
| EXAMPLE 12 | HTM-6 | | | | 0 | A | 66 | B | 168 |
| EXAMPLE 13 | HTM-7 | | | | 0 | A | 35 | B | 169 |
| EXAMPLE 14 | HTM-8 | | | | 0 | A | 41 | B | 168 |
| EXAMPLE 15 | HTM-9 | | | | 0 | A | 31 | B | 170 |
| EXAMPLE 16 | HTM-10 | | | | 0 | A | 28 | B | 172 |
| COMPARATIVE EXAMPLE 1 | HTM-1 | | Resin-4 | 0.3333 | 8 | C | 342 | D | 162 |
| COMPARATIVE EXAMPLE 2 | HTM-2 | ETM-2 | | | 10 | C | 225 | D | 161 |
| COMPARATIVE EXAMPLE 3 | HTM-3 | ETM-3 | | | 10 | C | 253 | D | 161 |
| COMPARATIVE EXAMPLE 4 | HTM-11 | ETM-1 | Resin-1 | 0.3633 | 8 | C | 518 | D | 163 |
| COMPARATIVE EXAMPLE 5 | HTM-11 | | Resin-4 | 0.3333 | 10 | C | 736 | D | 165 |

As shown in Table 2, when photoconductive members of Examples 1 to 16 according to the present invention are used, no cracks generated and also black spots scarcely generated. In contrast, when photoconductive members of Comparative Examples 1 to 5 are used, a large number of cracks generated and also a large number of black spots generated.

As described above, according to the present invention, by using an amine compound represented by the general formula (1) having an excellent hole transfer rate as a hole transferring material and using a binder resin having an IV/OV value of 0.36 or more, it is possible to suppress generation of cracks of a photoconductive layer while maintaining high electrical characteristics of a photoconductive member and to suppress generation of black spots in the formed image.

Therefore, according to the photoconductive member of the present invention and an image forming apparatus using the same, it is possible to realize extension of life and speedup of various image forming apparatuses such as a copying machine and a printer.

An aspect of the present invention, which was described above, pertains to an electrophotographic photoconductive member including a substrate, and a photoconductive layer containing a hole transferring material, a charge generating material and a binder resin, wherein the binder resin has a IV/OV value in which an inorganic value (IV) is divided by an organic value (OV) of 0.36 or more and also, the hole transferring material contains an amine compound represented by the following general formula (1):

(1)

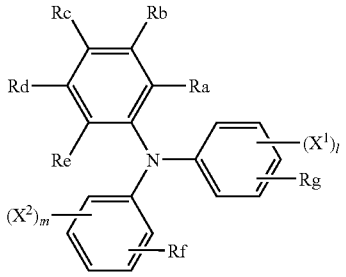

wherein, in the general formula (1), Ra to Rg each independently represents a hydrogen atom, a halogen atom, an alkyl group having 1 to 20 carbon atoms, an alkoxy group having 1 to 20 carbon atoms, a substituted or unsubstituted aryl group having 6 to 30 carbon atoms, or a hydrocarbon ring structure formed from two adjacent substituents among Ra to Re; $X^1$ and $X^2$ each independently represents a substituent represented by the following general formula (2), and each may be the same or different when a plurality of either or both of $X^1$ and/or $X^2$ exist; and the number of substituents l and m represent an integer of 0 or a positive integer, which satisfy the following relation: $(l+m \geqq 2)$;

(2)

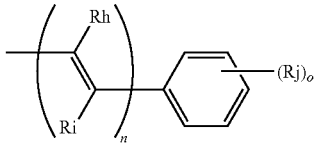

wherein, in the general formula (2), Rh and Ri each represents a hydrogen atom, an alkyl group having 1 to 20 carbon atoms, or a substituted or unsubstituted aryl group having 6 to 30 carbon atoms; the repeating number n represents an integer of 1 or 2; Rj represents a halogen atom, an alkyl group having 1 to 20 carbon atoms, an alkoxy group having 1 to 20 carbon atoms, or a substituted or unsubstituted aryl group having 6 to 30 carbon atoms, and may be the same or different when a plurality of Rj exist; and the number of a substituent o represents an integer of 0 to 5.

By using an amine compound represented by the general formula (1) having a high hole transfer rate as the hole transferring material, high electrical characteristics of the electrophotographic photoconductive member can be maintained. By using a high inorganic binder resin having an IV/OV value of 0.36 or more, it is possible to suppress generation of cracks due to adhesion of an oil component on the surface of a photoconductive layer and to suppress black spots in the formed image.

The amine compound represented by the general formula (1) preferably is at least one compounds represented by the following general formulas (3) to (5):

(3)

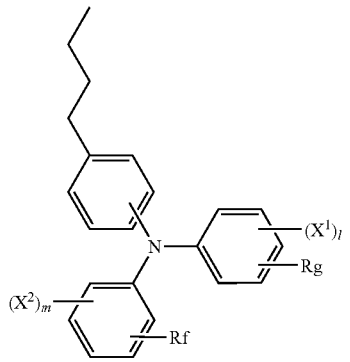

wherein, in the general formula (3), Rg, Rf, $X^1$ to $X^2$ and the number of substituents l and m are as defined in the general formula (1):

(4)

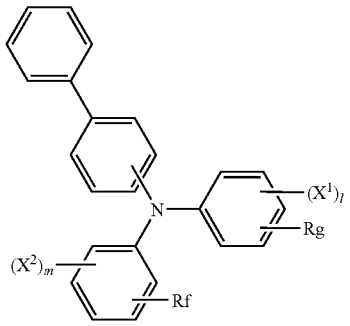

wherein, in the general formula (4), Rg, Rf, $X^1$ to $X^2$ and the number of substituents l and m are as defined in the general formula (1):

(5)

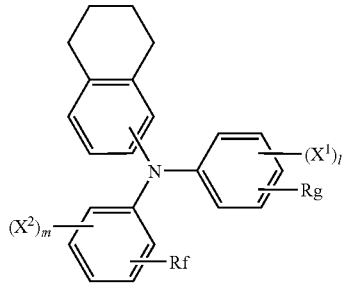

wherein, in the general formula (5), Rg, Rf, $X^1$ to $X^2$ and the number of substituents l and m are as defined in the general formula (1), because generation of cracks and black spots of the formed image can be suppressed more effectively by decreasing crystallinity of the hole transferring material.

The amine compound represented by the general formula (1) preferably includes compounds represented by the following formula (12), because generation of cracks and black spots of the formed image can be suppressed more effectively by decreasing crystallinity of the hole transferring material:

(12)

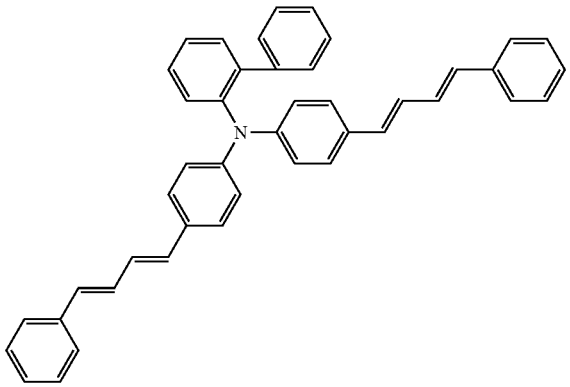

In the electrophotographic photoconductive member, the photoconductive layer is preferably a single-layered photoconductive layer, and the content of the amine compound represented by the general formula (1) is preferably within a range from 10 to 100 parts by mass based on 100 parts by mass of the binder resin. In such a case, since the amine compound becomes difficult to be crystallized in the photoconductive layer, high electrical characteristics can be maintained.

In the electrophotographic photoconductive member, the photoconductive layer is preferably a multi-layered photoconductive layer comprising a charge transferring layer containing the binder resin and the hole transferring material, and the content of the amine compound represented by the general formula (1) is preferably within a range from 10 to 500 parts by mass based on 100 parts by mass of the binder resin. In such a case, since the amine compound becomes difficult to be crystallized in the photoconductive layer, high electrical characteristics can be maintained.

(22)

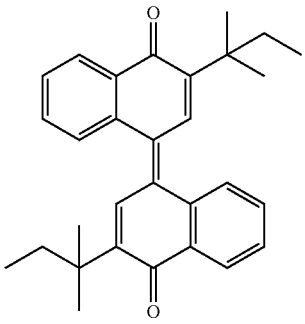

In such a case, generation of cracks and black spots of the formed image can be suppressed more effectively.

In the electrophotographic photoconductive member, the viscosity average molecular weight of the binder resin is preferably within a range from 10,000 to 60,000.

In such a case, stability to an oil component can be more improved and also compatibility between the binder resin and the amino compound is improved.

In the electrophotographic photoconductive member, the photoconductive layer preferably contains a compound represented by the following general formula (7):

(7)

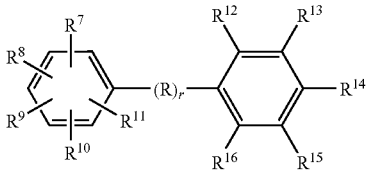

wherein, in the general formula (7), $R^7$ to $R^{16}$ each independently represents a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 6 to 30 carbon atoms, a substituted or unsubstituted cycloalkyl group having 3 to 12 carbon atoms, The electrophotographic photoconductive member preferably contains, as the binder resin, a polycarbonate resin represented by the following general formula (6):

(6)

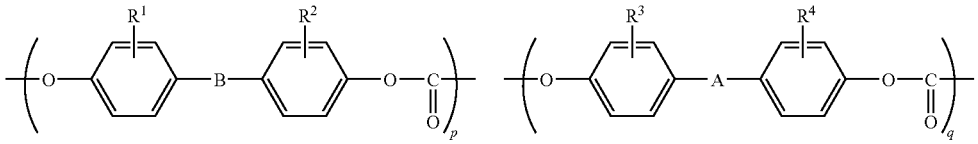

$p + q = 100, 5 < p < 60$ wherein, in the general formula (6), $R^1$ to $R^4$ each independently represents a hydrogen atom, a substituted or unsubstituted alkyl group having 1 to 20 carbon atoms, a substituted or unsubstituted aryl group having 6 to 30 carbon atoms; A represents —O—, —S—, —CO—, —COO—, $—(CH_2)_2—$, —SO—, $—SO_2—$, $—CR^5R^6—$, $—SiR^5R^6—$, or $SiR^5R^6—O—$ ($R^5$ and $R^6$ each independently represents, a hydrogen atom, a substituted or unsubstituted alkyl group having 1 to 8 carbon atoms, a substituted or unsubstituted aryl group having 6 to 30 carbon atoms, a trifluoromethyl group, or $R^5$ and $R^6$ may be combined to form, as a ring, a cycloalkylidene having 5 to 12 carbon atoms which may have an alkyl group having 1 to 7 carbon atoms as a substituent); and B represents a single bond, —O—, or —CO—.

In such a case, a binder resin having an IV/OV value of 0.36 or more is easily obtained and also a high photoconductive layer having a high mechanical strength is obtained.

In the electrophotographic photoconductive member, the photoconductive layer contains an electron transferring material represented by the following general formula (22) a hydroxyl group, a cyano group, a nitro group, or an amino group; R represents a substituted or unsubstituted alkylene group having 1 to 12 carbon atoms or an organic group containing a nitrogen atom; and the repeating number r represents an integer of 0 to 3.

In such a case, the compound serves as a plasticizer and relieves internal stress of the photoconductive layer, thus making it possible to further suppress generation of cracks.

Another aspect of the present invention pertains to an image forming apparatus comprising a drum-type electrophotographic photoconductive member made up from the above photoconductive member, a charger, a developing device and a transfer roller; the charger, the developing device and the transfer roller are arranged around the drum-type electrophotographic photoconductive member and also any one of the elements is arranged in contact with the drum-type electrophotographic photoconductive member.

Generation of cracks tends to be promoted by applying a mechanical force when the charger, the developing device or the transfer roller is brought into contact with the photoconductive layer. When the image forming apparatus is equipped with any one of the electrophotographic photoconductive members described above, cracks become difficult to be generated even when the charger is brought into contact with the electrophotographic photoconductive member. Also, a high quality image with suppressed black spots is formed.

This application is based on patent application No. 2006-342692 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An electrophotographic photoconductive member comprising a substrate, and a photoconductive layer containing a charge generating material, a hole transferring material and a binder resin, wherein the binder resin has a IV/OV value in which an inorganic value (IV) is divided by an organic value (OV) of 0.36 or more and also, the hole transferring material contains an amine compound represented by the following general formula (1):

(1)

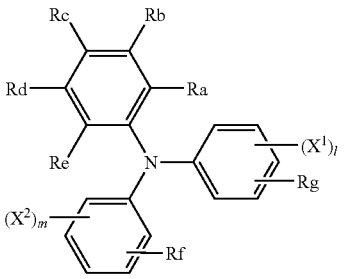

wherein, in the general formula (1), Ra to Rg each independently represents a hydrogen atom, a halogen atom, an alkyl group having 1 to 20 carbon atoms, an alkoxy group having 1 to 20 carbon atoms, or a substituted or unsubstituted aryl group having 6 to 30 carbon atoms, or a hydrocarbon ring structure formed from two adjacent substituents among Ra to Re; $X^1$ and $X^2$ each independently represents a substituent represented by the following general formula (2), and each may be the same or different when a plurality of either or both of $X^1$ and/or $X^2$ exist; and the number of substituents l and m represent an integer of 0 or a positive integer, which satisfy the following relation: ($l+m \geqq 2$);

(2)

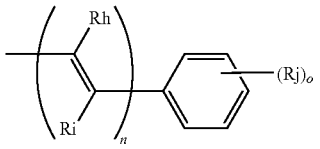

wherein, in the general formula (2), Rh and Ri each represents a hydrogen atom, an alkyl group having 1 to 20 carbon atoms, or a substituted or unsubstituted aryl group having 6 to 30 carbon atoms; a repeating number n represents an integer of 1 or 2; Rj represents a halogen atom, an alkyl group having 1 to 20 carbon atoms, an alkoxy group having 1 to 20 carbon atoms, or a substituted or unsubstituted aryl group having 6 to 30 carbon atoms, and may be the same or different when plurality of Rj exist; and the number of a substituent o presents an integer of 0 to 5.

2. The electrophotographic photoconductive member according to claim 1, wherein the amine compound represented by the general formula (1) is at least one compounds represented by the following general formulas (3) to (5):

(3)

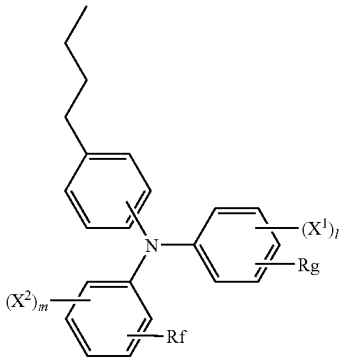

wherein, in the general formula (3), Rg, Rf, $X^1$, $X^2$, and the number of substituents l and m are as defined in the general formula (1):

(4)

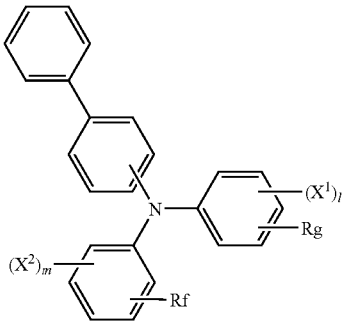

wherein, in the general formula (4), Rg, Rf, $X^1$, $X^2$, and the number of substituents l and m are as defined in the general formula (1):

(5)

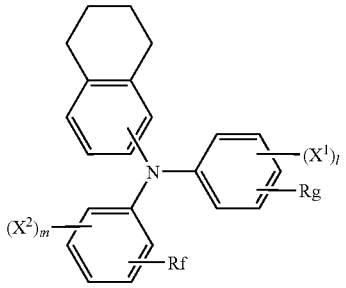

wherein, in the general formula (5), Rg, Rf, $X^1$, $X^2$, and the number of substituents l and m are as defined in the general formula (1).

3. The electrophotographic photoconductive member according to claim 1, wherein the amine compound represented by the general formula (1) includes a compound represented by the following formula (12):

(12)

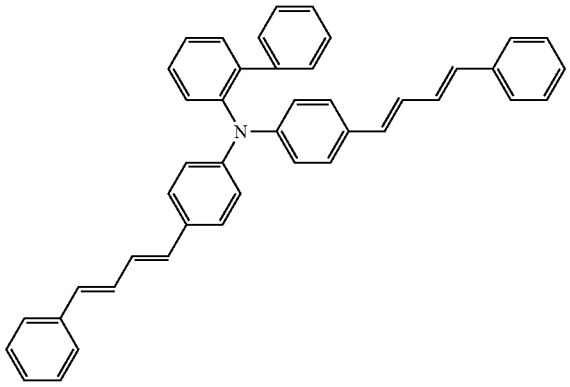

4. The electrophotographic photoconductive member according to claim 1, wherein the photoconductive layer is a single-layered photoconductive layer, and the content of the amine compound represented by the general formula (1) is within a range from 10 to 100 parts by mass based on 100 parts by mass of the binder resin.

5. The electrophotographic photoconductive member according to claim 1, wherein the photoconductive layer is a multi-layered photoconductive layer comprising a charge transferring layer containing the binder resin and the hole transferring material, and the content of the amine compound represented by the general formula (1) is within a range from 10 to 500 parts by mass based on 100 parts by mass of the binder resin.

6. The electrophotographic photoconductive member according to claim 1, which contains, as the binder resin, a polycarbonate resin represented by the following general formula (6):

(6)

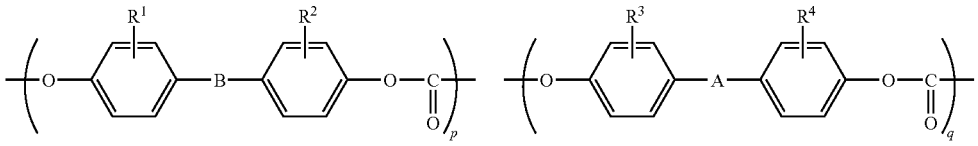

$p + q = 100, 5 < p < 60$ wherein, in the general formula (6), $R^1$ to $R^4$ each independently represents a hydrogen atom, a substituted or unsubstituted alkyl group having 1 to 20 carbon atoms, or a substituted or unsubstituted aryl group having 6 to 30 carbon atoms; A represents —O—, —S—, —CO—, —COO—, $—(CH_2)_2—$, —SO—, $—SO_2—$, $—CR^5R^6—$, $—SiR^5R^6—$, or $SiR^5R^6—O—$ ($R^5$ and $R^6$ each independently represents, a hydrogen atom, a substituted or unsubstituted alkyl group having 1 to 8 carbon atoms, a substituted or unsubstituted aryl group having 6 to 30 carbon atoms, a trifluoromethyl group, or $R^5$ and $R^6$ may be combined to form, as a ring, a cycloalkylidene having 5 to 12 carbon atoms which may have an alkyl group having 1 to 7 carbon atoms as a substituent); and B represents a single bond, —O—, or —CO—.

7. The electrophotographic photoconductive member according to claim 1, wherein a viscosity average molecular weight of the binder resin is within a range from 10,000 to 60,000.

8. The electrophotographic photoconductive member according to claim 1, wherein the photoconductive layer contains an electron transferring material represented by the following formula (22):

(22)

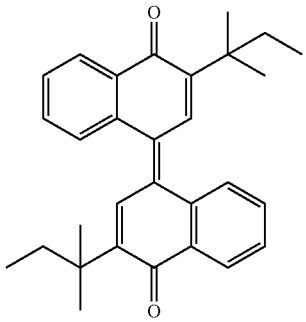

9. The electrophotographic photoconductive member according to claim 1, wherein the photoconductive layer contains a compound represented by the following general formula (7):

(7)

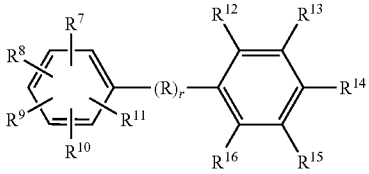

wherein, in the general formula (7), $R^7$ to $R^{16}$ each independently represents a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 6 to 30 carbon atoms, a substituted or unsubstituted cycloalkyl group having 3 to 12 carbon atoms, a hydroxyl group, a cyano group, a nitro group, or an amino group; R represents a substituted or unsubstituted alkylene group having 1 to 12 carbon atoms or an organic group containing a nitrogen atom; and a repeating number r represents an integer of 0 to 3.

10. An image forming apparatus comprising a drum-type electrophotographic photoconductive member according to claim 1, a charger, a developing device and a transfer roller; the charger, the developing device and the transfer roller are arranged around the drum-type electrophotographic photoconductive member and also any one of the elements is arranged in contact with the drum-type electrophotographic photoconductive member.

* * * * *